US006468597B1

(12) United States Patent
Domes

(10) Patent No.: US 6,468,597 B1
(45) Date of Patent: Oct. 22, 2002

(54) PROCESS FOR THE PRODUCTION OF A POLYMERIC FILM ON A METAL SURFACE, AND CONCENTRATE AND TREATMENT LIQUID THEREFOR

(75) Inventor: Heribert Domes, Weilmünster (DE)

(73) Assignee: Chemetall GmbH, Frankfurt am Main (DE)

( * ) Notice: Subject to any disclaimer, the term of this patent is extended or adjusted under 35 U.S.C. 154(b) by 0 days.

(21) Appl. No.: 09/672,578

(22) Filed: Sep. 28, 2000

(30) Foreign Application Priority Data

Sep. 30, 1999 (DE) ..... 199 47 233

(51) Int. Cl.[7] ..... B05D 1/02; B05D 3/06; B05D 7/16

(52) U.S. Cl. ..... 427/512; 427/514; 427/518; 427/318; 427/409; 427/422; 427/435; 427/555; 427/379

(58) Field of Search ..... 427/318, 409, 427/379, 508, 512, 514, 518, 355, 422, 435

(56) References Cited

U.S. PATENT DOCUMENTS 4,690,837 A 9/1987 Doroszkowski et al. .... 427/314
5,283,280 A 2/1994 Whyte et al. ..... 427/374.1
5,391,396 A * 2/1995 Morrand ..... 106/14.26
5,714,093 A * 2/1998 Heimann et al. ..... 106/14.34

FOREIGN PATENT DOCUMENTS

DE 197 25 780 12/1998
WO 94/10244 5/1994

* cited by examiner

*Primary Examiner*—Erma Cameron
(74) *Attorney, Agent, or Firm*—Fulbright & Jaworski LLP

(57) ABSTRACT

The invention relates to a method for producing a plastic film on metal surfaces, and a treatment liquid for producing this film. The treatment liquid, prior to wetting the metal, contains 0.1 to 50% (by weight) of a non-volatile film-forming mixture of resins, and 99.9 to 50% of a water-miscible, water-soluble or water solvent, and forms a film on the metal. The treatment liquid, just prior to wetting the metal, has a temperature of 10–100° C., and the metal surface has a temperature higher than the treatment liquid by at least 20° C. and a temperature in the region of 30 to 700° C. The treatment liquid is adjusted in such a way that its constituents do not substantially coagulate, settle or decompose, and such that the molecular weight distribution and the viscosity of the treatment liquid does not substantially change during use.

30 Claims, No Drawings

PROCESS FOR THE PRODUCTION OF A POLYMERIC FILM ON A METAL SURFACE, AND CONCENTRATE AND TREATMENT LIQUID THEREFOR

The invention relates to a method for producing a film of plastics or a plastics-containing material on a metal surface and a concentrate for producing a treatment liquid and a treatment liquid for producing the polymer film.

Polymer films on metal surfaces are used in many different ways. There are also all types of methods on an industrial scale for coating of metallic work pieces or work pieces having a metallic surface with a polymer film. According to the type of metal surface and the work pieces, it can be feasible for the application of a polymer film to be carried out without difficulties or it can have considerable disadvantages. As a result of the suitable chemical and physical adjustment of the polymer solution or dispersion to be applied, a polymer layer of the desired thickness can be generated in one operation by several methods. For example, with a roller application method such as roll coating, it is of particular significance to coordinate with each other the concentration of the plastics-containing treatment solution and the roller pressure of the application device, the roller speed and the running direction of the rollers with respect to the substrate. The treatment of small or relatively large-area, rounded work pieces, which are mostly coated by the electric immersion method or by the spraying method, also proves to be comparatively simple.

On the other hand, difficulties are often caused by the coating of single parts, in particular if they have a fairly large spatial extent, for example car body parts, bumpers, chassis, panellings, crash barriers.

With such substrates the roller application method has to be ruled out. Spraying methods are uneconomical in particular because of the costly industrial engineering and the high portion of treatment liquid being lost (over-spray). Dipping methods at ambient temperature without electrical deposition have the disadvantage that, due to the geometry of the parts, different layer thicknesses are generated, and that drops of the plastics-containing solution or dispersion remain on the run-off points, the drops being visible as a thickening after the subsequent drying. Even after a subsequent spray lacquering, these thickenings are clearly recognizable. In addition to the not very attractive appearance, the treated parts—in each case according to the purpose of use—are possibly also useless due to a lack of accuracy of fit.

DE-A-197 25 780 describes a method for applying plastics or plastics-containing layers to metallic single parts approximately at ambient temperature and its use as pretreatment of the single parts for the subsequent powder coating. In this respect, a solution or dispersion with a content of 5 to 50% by weight of an organic polymer is brought into contact with the metallic single part, the applied solution or dispersion is dried on, the coated single part is then brought into contact with a substantially identical, but greatly diluted, solution or dispersion, and its drying is completed. Drop-like areas of unevenness and fairly large thickenings are avoided by the double dipping treatment. Nevertheless, the layer thickness at the run-off edge is often larger than at the other surfaces of the single part by the factor 2 to 3. However, if dipping were to take place only once, the layer thickness at the run-off edge would be about 30 to 53 times thicker than at the other surfaces of the single part.

On the other hand, with a thin layer treatment the conventional chromating, for example on aluminium, zinc and their alloys, still provides the best protection against corrosion without subsequent lacquering. Hitherto it has been a very good and common pretreatment for a subsequent lacquering. As a result of chromium-containing solutions being harmful to the environment and being toxic, in particular from $Cr^{6+}$-ions, for years there have been intensive efforts to develop economical coating methods suitable for line production, which enable protection against corrosion which is equivalent to chromating, also without the use of chromium.

WO 94/10244 describes several compositions for the pretreatment of substrates with polymer solutions or dispersions and a method for coating substrates with such treatment liquids. In this respect, it is mainly treatment liquids which are applied with the dipping method which are mentioned, with a polymer solution or dispersion being mixed with a so-called "compatible dispersion" and with water and the bath being heated to a temperature in the region of about 27 to 71° C., and the parts to be coated heated to a temperature in the region of about 104 to 927 C. The so-called compatible dispersion contains, according to the examples, for example graphite, aluminium, titanium oxide or a black pigment, with it being indicated that the mixtures with a compatible dispersion corresponding to the examples are pigment dispersions for inking protective films and for improving the sliding ability of the substrate surface (sliding lacquer) treated therewith. The examples describe in each case two synthetic resins with a pigment addition, but no content of corrosion inhibitors for improving the anti-corrosion properties. The synthetic resins used are acid-functional, physically drying acrylate resins which are not resistant to alkaline media (pH 6–14). For this reason, only slight protection against corrosion is to be expected. The dry film resulting from this formulation is not resistant to alkaline liquids, for example cutting oils, lubricants for cutting shaping or alkaline water lacquers for over-lacquering used for the further processing of the coated parts.

It was therefore an object of the present invention to provide a method for applying plastics or plastics-containing layers to substrates with metallic surface, which avoids the known, in particular the aforementioned, disadvantages, and also permits layers to arise at the run-off point of the coated substrates, which have a layer thickness which corresponds largely with the layer thickness of the other surface regions coated with plastics. This method should lead, as far as possible also without the use of chromate, to results which are equivalent to those of chromating.

The object is achieved with a method for producing a plastics film or a plastics-containing film on a metal surface, where a treatment liquid, which at the beginning of the wetting with the treatment liquid contains 0.1 to 50% by weight of a non-volatile film-forming mixture containing one or more resins, and 99.9 to 50% by weight of a water-miscible and/or water-soluble solvent and/or water, forms a film on the metal surface, with the volatile component escaping at least partially, with the treatment liquid at the beginning of the wetting, with the treatment liquid having a temperature in the region of 10 to 100° C., with the metal surface at the beginning of the wetting with the treatment liquid having a temperature higher than the treatment liquid by at least 20° C. and a temperature in the region of 30 to 700° C., and with the film being used for the treatment of the metal surface.

The temperature difference between the metal surface and the treatment liquid at the beginning of the wetting with the treatment liquid advantageously amounts to at least 25°

C., preferably at least 32° C., particularly preferably at least 45° C., very particularly preferably at least 55° C. Moreover, the temperature of the substrate can advantageously lie at least 70° C., at least 100° C. or in many cases at least 150° C. above the temperature of the treatment liquid. The selected temperature difference can depend substantially on the type of heating of the substrates and optionally also on the integration into a line production, not only on the chemical and physical conditions of the film formation.

By the term "polymer film" in this application is to be understood a film of plastics or of a plastics-containing material. In the method in accordance with the invention, the treatment of the metal surface is understood to mean the application of a passivating layer to the surface of a metallic material (alloy or metal), with it preventing the corroding of metal surfaces. The term "treatment" within the meaning of this application is also to include the term "pretreatment", so far as this is not presented otherwise at the respective passage, with a layer which protects alone usually only temporarily being applied, which is later superimposed by at least one further protective layer, in particular lacquer layer. However, within the meaning of this application, this term is not to include the formation of a bonding agent layer. Within the meaning of this application, the term "hardening" is to include both chemical cross-linking, and physical hardening. Within the meaning of this application, the term "water-miscible" is to be understood as the generic to the term "water-dispersible".

As metal surface are meant both the surface of a metallic workpiece (substrate) consisting of at least one metal and/or at least one alloy, where the metal or the alloy reaches the surface, and a work piece consisting of any material which is provided with a metallic coating and therefore has a metal surface on which a polymer protective layer is applied in turn. In this respect, these can be, above all, substrates with a metal surface on a plastics-containing work piece, such as a fibre composite material—for example for bumpers, panellings, car body parts. This requires comparatively low treatment temperatures.

The substrate can consist essentially of aluminium, iron, copper, magnesium, zinc, tin and/or at least one of their alloys and, if necessary, can be additionally metallically coated, in particular with aluminium, lead, copper, zinc, tin or their alloys. The metallic coating can have been applied in particular by way of hot dipping, thermal spraying or by physical, chemical or electrolytic deposition. The metallic substrate would preferably have been produced, among other ways, by way of casting and/or rolling.

In many cases it is advantageous if, before the wetting with the film-forming treatment liquid, the metal surface is provided with a bonding agent layer—either with an inorganic bonding agent layer, in particular with a bonding agent layer containing phosphate, a bonding agent layer containing silicate or a bonding agent layer containing zirconium and/or titanium, and/or with an organic bonding agent layer, in particular with a bonding agent layer containing phosphonate, polyvinyl butyral wetted with acids (conventional wash primer) and/or at least one butyl titanate and/or silane. Here, a combination of a zirconium compound and titanium compound with a silane can also be selected. In this way, a situation is achieved where the adhesion of the film is improved and, in the event of damage to the film, infiltration as a result of moisture or aggressive substances is limited. If the bonding agent layer is to withstand in a substantially unimpaired manner a greater thermal load on the substrate and then the treatment with the polymer layer, in many cases an inorganic bonding agent layer is to be selected. Organic bonding agent layers can often also be used with transient action at temperatures up to 250° C.

The temperature of the treatment liquid frequently amounts to at least 18° C., but just at the beginning of the working in a cold environment it can also lie below that. It can exceed 25° C. and possibly 35° C., without the treatment liquid having to be specially heated. It can also lie at temperatures of at least 45° C., but will only come to lie above 60° C. with certain uses. The temperature of the substrate can in particular then amount to at least 60° C., optionally at least 90° C., possibly also at least 120° C.; however, the temperature can also be much higher, in particular at at least 150° C., above all at at least 200° C. or at at least 250° C. An increased temperature of the treatment liquid can offer the following advantages.

1.) The temperature of the parts to be treated is not cooled too greatly during the dipping, so that the remaining residual heat of the parts is used for the accelerated drying of the wet film applied by way of the dipping method.

2.) Higher temperatures of the treatment liquid result in greater dry layer thicknesses in the application. With higher temperatures, for example in the region of 50 to 80° C., it is therefore possible to work with small concentrations (for example 0.5 to 3% by weight) of the dry residue in the treatment liquid, and nevertheless attain sufficiently thick films (for example without pigment 0.5 to 5 $\mu$m). On the other hand, at a temperature in the region of 20 to 30° C. a concentration of the dry residue in the treatment liquid in the region of 8 to 12% by weight is necessary for the same film thickness.

With the use of the heat from a hot dipping process, a temperature of the substrate at the beginning of the wetting with the treatment liquid can be selected in the region of 200 to 450° C. for the hot galvanizing with zinc or a zinc alloy and in the region of 200 to 700° C. for the hot dipping into a melt of aluminium or an aluminium alloy, for example an alloy based on AlSi, Galvalumel (55%Al—Zn), Galfan® or Crack-Free-Steel®. The temperature preferably lies at the level which the substrates to be coated have immediately after or a short time after leaving a furnace. In this respect, it can be, in particular, a furnace for hardening, annealing or tempering or an arrangement for hot dipping. The temperature is advantageously to be selected with consideration of the volume of the substrates to be coated, the bath volume, the bath composition and the layer thickness provided, in such a way that, after the wetting and extraction of the substrate, the treatment liquid dries at least partially and the film formed hardens at least partially.

The organic polymers, in most cases synthetic resins, are frequently, but in no way in all cases, with molecular weights in the order of magnitude of about 800 to about 2000, being in a solid state at ambient temperature and usually being able to dissolve well. However, with increasing molecular weight, the solubility decreases. Polymers with molecular weights in the region below about 1000 are frequently naturally liquid. Both groups of substance are sometimes water-miscible and/or water-soluble, according to the composition or to some extent according to the number of groups which can be neutralized. The addition of specific organic solvent to the water can increase the solubility of the polymers considerably.

The resin or resins can be synthetic resins, in particular acrylates, polyesters, polyurethanes, silicon polyesters, epoxides, phenols, styrenes, resins based on urea formaldehyde, their mixtures and/or their copolymers, preferably hexamethoxymethyl melamine (HMMM) resins and/or their mixtures and/or copolymers from several substances of the named groups of substances. However, natural resins can also be used.

The resin or resins can be present in solution or as a dispersion, in particular as emulsion or suspension; a solution is preferably used. Suitable for the deposition, in accordance with the invention, of a film on a metal surface at increased temperature are, in particular, synthetic resins which are present in the treatment liquid in the form of a solution, for example neutralized acid-functional acrylate resins with an acid number of at least 50, mostly in the region of 150 to 250.

Moreover, it is to be observed that the treatment liquid contains synthetic resins which contain a sufficient number of neutralized or neutralizable groups. Synthetic resins with almost 100% neutralizable or neutralized groups or, rather, synthetic resins with an addition of neutralization agents in excess can usually dissolve well in water. In this way, coagulation, which can easily occur above 40° C., can be avoided.

The neutralization is preferably carried out with neutralization agents of different volatility, for example with several amines. In this way, a situation is achieved where the films produced are water-resistant already very soon after the beginning of the drying. For this purpose, two or three of the following types of neutralization agent could be used:

1.) a long-volatile neutralization agent, for example 2-amino-2-methyl-1-propanol;
2.) a medium-volatile neutralization agent, for example 2-dimethylaminoethanol; and
3.) a short-volatile neutralization agent, for example ammonia or triethylamine.

These neutralization agents can be used, for example, in the mixing proportion 1:1:1. Such a mixture is simultaneously coordinated with optimum solubility or dispersability of the resins in the treatment liquid and therefore with optimum bath stability in the temperature region up to 100° C. and with optimum resistance to water and resistance to weathering after the drying.

Aqueous solutions are particularly advantageous for the method in accordance with the invention. With aqueous solutions, the defects which can possibly occur with dispersions usually do not apply. Dispersions can be suitable and can be used in many cases, but can also produce in certain situations the disadvantages cited in the following.

1.) Dispersions which are used for the film formation and which therefore contain an undissolved resin often require emulsifiers and/or protective colloids in order to keep the undissolved resin homogeneously distributed in the liquid. However, the emulsifiers and protective colloids are both hydrophobic and hydrophilic. After the film forming they remain in the dry film and only partially lose their hydrophilic character. As a result of these substances the dried layer is in a position to absorb water to a greater extent, although this is not desirable. The increased capacity of the protective layers to absorb water is disturbing because the anti-corrosion effect (weathering resistance) is substantially reduced in the process. Films which have been produced from dispersions can of course be chemically cross-linked in the presence of special coreactants, but, as a result of their special composition, the proportion of cross-linking possibilities is limited. The cross-linked films produced in this way are, admittedly, more resistant to weathering influences and chemicals in comparison with films from dispersions which are not cross-linked, but are substantially less resistant in comparison with three-dimensionally cross-linked films which are produced from polymer solutions.
2.) Dry films which are produced from dispersions which contain emulsifier and/or protective colloid and which contain an undissolved resin can therefore be disadvantageous with respect to resistance to chemical media and weathering in comparison with a dry film which is generated from a polymer solution free of emulsifier and protective colloid. Such polymer solutions free of emulsifier and protective colloid often allow a chemical cross-linking, whereby, for example, resins containing carboxyl groups with melamine formaldehyde can react to form a three-dimensionally cross-linked polymer.
3.) The emulsifiers of the dispersions which are used for the film formation and which therefore contain at least one undissolved resin finely dispersed in the liquid, in the form of particles of at most 90% by volume up to about 1 $\mu$m size, are often not sufficiently temperature-stable, because their properties change during the temperature action of the hot substrates, which can lead to an irreversible coagulation of the resin particles in the treatment liquid. The coagulated resin particles are then often too large to be able to form a sealed protective film on the substrate, and the treatment liquid is then useless.
4.) Another disadvantage of a dispersion which is used for the film formation and which therefore contains an undissolved resin can lie in that resin particles with high molecular weights are present and therefore, after a partial film forming caused by the high temperatures of the parts to be treated, in particular above 250° C., can no longer be absorbed by the treatment liquid and build up on the walls of the dip tanks and/or float on the surface of the liquid. The resin particles formed into filming can be mechanically separated from the walls of the dip tanks, conditional upon the process, and can float as large agglomerates likewise on the surface of the treatment liquid and thereby contaminate it. This can lead to the agglomerates partially formed into films being incorporated in the form of particles, flecks and/or flakes in the drying film. The particles are possibly up to 100 or even up to 200 $\mu$m large and then cause a great roughness of the film. Such rough areas would have to be smoothed again in a costly manner, before a lacquering is applied.

Dispersions with so-called internal emulsifiers behave in a different way. No foreign substances are added to these dispersions and they behave excellently because no uncontrolled hydrophilicity effects can occur.

At least one water-miscible and/or water-soluble alcohol, a glycol ether or N-methyl pyrrolidone and/or water can be used as solvent for the organic polymers in the treatment liquid, in the case of the use of a solvent mixture in particular a mixture of at least one long-chain alcohol, for example propylene glycol, an ester alcohol, a glycol ether and/or butandiol with water, preferably only water.

The water used can have the quality, for example, of tap water, well water or recycled water. However, in many cases it is advantageous or it is advisable for a line production to use a partially or completely deionised water quality in order to limit the undesirable salting of the treatment liquids as a result of the salt burdens of the water used.

The treatment liquid can contain at least one volatile and/or non-volatile additive for the adjustment of defoaming, adhesion, conservation, in particular against attack by fungus and bacteria, neutralization, surface wetting, rheology and/or levelling. The expert in the field of polymers knows what quantity of one or more of these additives to use in order to thereby adjust stable solutions and dispersions. If, in the method in accordance with the invention, corrosion inhibitors are added as pigments and/or in dissolved form, for example at least one phosphate, titanate and/or zirconate, in particular dicalcium phosphate, dimagnesium phosphate, iron-III-phosphate, modified alkali phosphate, aluminium triphosphate and at least one zirconium complex compound, an improved protection against corrosion of the entire layer can be achieved. The anti-corrosion effect of the resins can also be substantially increased by the addition of an N-ethyl morpholine complex. This is advantageous in particular for the service life of the components to be treated. Precisely for the sections of a substrate, for example a car body with corners, folds and cavities, which are insufficiently covered by the subsequent spray lacquering, it is particularly advantageous if the sections which are subsequently not sufficiently lacquered have a high resistance to corrosion as a result of the content of corrosion inhibitors in the film. Surprisingly, it has emerged that with the method in accordance with the invention it is also possible to achieve a sufficient protection against corrosion at the sections of a car body, consisting of zinc-coated steel or of an aluminium alloy, which are covered insufficiently with lacquer. Moreover, so-called dryings-on, for example runs, tear-drops, thickening at the edges as a result of the running-off of treatment liquid are avoided with the method in accordance with the invention. It has been found that substrates coated in accordance with the invention have an almost constant film thickness over the entire surface.

The treatment liquid can contain at least one neutralization agent, for example an amine, in particular at least one alkanolamine, ammonia and/or sodium hydroxide solution.

The pH value of the treatment liquid can advantageously be kept in a range of 1 to 11, preferably in the range of 4 to 10, particularly preferred in the range of 7 to 9.5.

The polymer film can be applied on the metal surface by dipping the substrate into the treatment liquid and by subsequent drying, with the substrate at the beginning of the wetting with the treatment liquid preferably having a temperature in the region of 100 to 200° C.

The polymer film can be applied to the metal surface by way of flooding, that is to say by pouring the treatment liquid over a surface of the substrate, and by subsequent drying, with the substrate at the beginning of the wetting with the treatment liquid preferably having a temperature in the region of 12 to 150° C., in particular at at least 32° C., preferably at at least 45° C.

The polymer film can be applied to the metal surface by spraying the substrate with the treatment liquid and by subsequent drying, with the substrate at the beginning of the wetting with the treatment liquid advantageously having a temperature in the region of 12 to 70° C., in particular at least 32° C., preferably at least 45° C. The spraying can take place in particular by way of atomization with air or without air.

The polymer film can be applied to the metal surface by wetting the substrate with the treatment liquid by way of wiping it on, brushing it on or rolling it on and by subsequent drying, with the substrate at the beginning of the wetting with the treatment liquid preferably having a temperature in the region of 12 to 70° C., in particular at at least 32° C., preferably at at least 45° C.

A rinsing after the application of the polymer film is not necessary and usually does not make any sense because the deposited film could be partially removed again in this way.

The method in accordance with the invention is particularly advantageous if, with a previous temperature treatment, for example annealing, tempering, hot dip coating (for example hot galvanizing) or a hardening treatment, the substrate is brought to the temperature necessary for the coating. In this way, considerable costs can be saved by avoiding an additional heating with the method in accordance with the invention.

In most cases the substrate will have a temperature of at least 50° C. above the temperature of the treatment liquid at the beginning of the wetting with the treatment liquid. It is advisable, in particular with hot-galvanized piece goods, for the substrate which is to be treated to be cooled more greatly or even quenched by way of the treatment.

After the deposition of polymer resin particles, the latter film physically and/or cross-link in the presence of suitable chemical coreactants chemically to form a sealed, even film. The polymer film can also be formed by physical film forming, that is to say the drawing-together of particles, for example as a result of the van der Waals forces upon the escape of water. The film forming is particularly favoured if synthetic resins with low glass transition temperatures are used or if corresponding film formers (for example long-chain alcohols) are added to temporarily soften the polymers. It is particularly favourable to use solutions of acrylates containing carboxyl groups in combination with melamine formaldehyde because chemical cross-linking is then possible. A particularly high chemical resistance and a high resistance to weathering is produced by way of the cross-linking.

A film is preferably formed which, after the drying, has a layer thickness of 0.01 to 50 $\mu$m, in particular is 0.1 to 20 $\mu$m, particularly preferably 0.5 to 7.5 $\mu$m. In many cases films in the region of 0.6 to 1.8 $\mu$m are preferred, in individual other cases films in the region of 2.0 to 18 $\mu$m.

The dwell time of the substrate in the dipping bath is preferably selected in such a way that the reactions in the treatment liquid during the wetting of the substrate with the treatment liquid are substantially or entirely ended. A vigorous or certain bubbling of gas bubbles in the region of the contacted substrate can be considered as an indication of the reactions. The dwell time can amount to 1 to 120 seconds. However, in many cases it will amount to only 2 to 60 seconds, advantageously only 3 to 30 seconds, often only 4 to 20 seconds. As a rule, it holds that the thinner or less hot the substrate is upon first contact with the treatment liquid, the shorter the dwell time can be selected to be.

Thicker films are produced with the method in accordance with the invention without greater increase of the concentration of the non-volatile components in the treatment liquid, in particular on substrates with thicker walls. As a result of their greater heat content, substrates with thicker walls tend to form s thicker films, with these layers also being able to cross-link and harden more greatly as a result of the larger amount of heat available. The high temperature and the high heat content of the parts to be treated enable a more rapid escape of the volatile constituents of the applied wet film and therefore enable a more rapid concentration of the dry substance contained in the treatment liquid. This can help films to be able to be processed further more quickly as a result of the higher degree of drying.

Thicker films can also be applied to substrates with thinner walls with the aid of a higher concentration of the non-volatile components in the treatment liquid.

The partially dried polymer film can be subsequently thermally treated for the final chemical cross-linking and physical hardening. Suitable for this purpose are, in particular, temperatures in the region of 100 to 400° C., preferably at 120 to 200° C., particularly preferably 140 to 180° C. In this respect, the temperature is related to the surface temperature of the substrate. The period of the subsequent thermal treatment can amount to 2 seconds to 2.5 hours, preferably 2 minutes to 1 hour, particularly preferably 10 to 30 minutes. In this respect, the higher the temperature is selected, the shorter the subsequent thermal treatment can turn out to be and vice versa. The treatment can take place, among other things, with IR radiation.

In a preferred variant of the method, the film to be cross-linked is hardened with UV radiation. In this way heat is avoided and the treatment period usually amounts to a fraction of a second to a few seconds. However, this usually requires a certain composition for the treatment liquid and the prior complete or almost complete expelling of the solvent or solvent mixture.

If a lacquer is to be applied to the formed film afterwards, the substrate coated with the film is preferably lacquered first, and then, during the subsequent thermal treatment, the polymer film and the lacquer applied thereto are simultaneously finally chemically cross-linked and/or physically hardened.

The method in accordance with the invention is particularly advantageous also for work pieces consisting of aluminium alloys, in particular for motor vehicle bodies provided with a bonding agent layer. If these are coated with a polymer film at a temperature which prevails as a result of the process after leaving a heat treatment system, for example at temperatures in the region of 260 to 130° C., preferably 220 to 160° C., the energy content present in the substrates to be coated can be used meaningfully in this way, without having to heat the substrates once again. The method in accordance with the invention can therefore be integrated into line production in an economical manner.

The method in accordance with the invention can also be used in a similar manner for hot-galvanized work pieces. In this respect, a formulation consisting of 28 parts by weight acid-functional acrylate resins, in particular with an acid number of about 135 and with a glass transition temperature of about 28° C., consisting of 71 parts by weight acid-functional acrylate resins, in particular with an acid number of about 215 and with a glass transition temperature of about 95° C., and consisting of 1 part by weight of an N-ethyl morpholine complex, has proven to be excellent, after the synthetic resins were neutralized with ammonia, 2-dimethylaminoethanol and 2-amino-2-methyl-1-propanol in a ratio of 1:1:1.

The method in accordance with the invention provides the possibility that there is additionally applied to the substrate a lacquer layer, a foil, a foam and/or an adhesive, with the substrate optionally being bonded with a further moulded body or with a foil.

With the method in accordance with the invention it is also possible to apply thicker films which can have, for example, a film thickness in the region of 5 to 25 $\mu$m. These films can be used as a single-layer lacquer coating. For this purpose, the concentration of the treatment liquid is increased, preferably to a content of 5 to 25% by weight dry substance in the treatment liquid to be able to apply thicker films. In this respect, it can be desirable to add colourant or covering components such as pigments or dissolved colourant materials to the treatment liquid, to form a lacquer layer which is colour coated and/or glazed in a coloured manner. In this way, effect enamellings and metallic enamellings can also be applied to a certain extent.

In addition to containing resin(s), the non-volatile, film-forming mixture can contain at least one inorganic additive in dissolved form and/or as most finely dispersed powder, for example a carbonate, chromate, oxide, silicate, for example laminated silicate, sulphate. This additive can be used as transparent or covering colourant material or as transparent filler and/or for lengthening the diffusion path of corrosive media in the dry film to the substrate surface. In this respect, flake-shaped particles are, in particular, of advantage.

Such a coating applied in one stage can be applied in a clearly more economical manner than an at least two-stage lacquering method according to the prior art. Moreover, by avoiding over-spray, work can take place to the greatest extent without loss. The drying time of the wet film is clearly reduced. In some cases—for example for zinc-coated structural parts for houses, bridges etc. or for road-safety devices, in particular traffic lights, lamps and crash barriers—there can be a move over to a physical and/or chemical drying, so that no additional thermal drying step is required. The coating applied in one stage is therefore also more economical than related lacquer coatings applied in one stage according to the prior art.

A decoration and/or a particular protection against mechanical effects can additionally be achieved with a foil. This is interesting in particular for small household devices, for example toasters and jugs or for covers of machines. In this respect, decorative foils, for example printed PVC foils, are state of the art. The foils can be self-adhesive or bonded by way of a separately applied adhesive.

An additional shield against noise and/or heat insulation can be achieved with a foam which is often applied in a thickness of 5 to 100 mm, for example with a polyurethane foam.

With an adhesive layer, it is possible to produce adhesive connections with other components, in particular metal parts. Such connections can be used, among other things, for vehicle bodies, trailers, motor caravans, aeroplanes. In addition, adhesive connections with glass, plastics, wood or other materials are also possible, for example for sticking glass panes in place.

Moreover, the object is achieved with a treatment liquid for producing a plastics film or plastics-containing film on a metal surface during the wetting of the metal surface with the treatment liquid when the treatment liquid contains 0.1 to 50% by weight of a non-volatile film-forming mixture containing one or more resins, and 99.9 to 50% by weight of a water-miscible or water-soluble solvent and/or water, and is kept at a temperature of 10 to 100° C., with the treatment liquid being adjusted in such a way that its constituents during the operating period, during the standing period and at the temperature of the film formation do not or almost do not coagulate, do not or do not substantially settle and are not or are not substantially decomposed, with the molecular weight distribution and the viscosity of the treatment liquid not substantially changing in use.

Finally, the object is achieved with a concentrate for producing a treatment liquid in accordance with the invention, with the concentrate producing the treatment liquid after diluting, with the concentrate containing 1 to 90% by weight of a non-volatile film-forming mixture containing one or more resins, and 99 to 10% by weight of a water-miscible and/or water-soluble solvent and/or water, with the concentrate and the treatment liquid being adjusted in such a way that their constituents during the storage period, during the operating period, during the standing period and at the temperature of the film formation do not or almost do not coagulate, do not or do not substantially settle and are not or are not substantially decomposed, and with the molecular weight distribution and the viscosity of the concentrate and the treatment liquid not changing substantially during the storage period and in use.

By the operating time is meant the working time with the treatment liquid in accordance with the invention, where hotter parts are brought into contact with the treatment liquid in order to form a polymer film thereon. The stability of the concentrate and the treatment liquid is to be guaranteed to the extent that no serious disturbances of the operation occur as a result of the instability.

The treatment liquid preferably contains 0.1 to 15% by weight of the non-volatile film-forming mixture and 99.9 to 85% by weight of a water-miscible and/or water-soluble solvent and/or water. Particularly preferably, the treatment liquid contains 0.1 to 5% by weight of the non-volatile film-forming mixture and 99.9 to 95% by weight of a water-miscible and/or water-soluble solvent and/or water. The preferred content of the non-volatile film-forming mixture in the treatment liquid can likewise vary according to the composition of the treatment liquid and the desired layer. In many cases the content of the non-volatile film-forming mixture in the treatment liquid will advantageously amount to at least 0.8% by weight or at most 3% by weight, in some cases at least 1% by weight or up to 2.5% by weight. The content of at least one solvent in the treatment liquid then amounts respectively to at most 99.2% by weight, or at least 97% by weight, or at most 99% by weight, or at most 97.5% by weight.

Treatment liquids suitable for the passivation of zinc-coated surfaces, in particular, have a content of the non-volatile film-forming mixture in the region of 0.5 to 5% by weight, preferably 1 to 3% by weight, and 99.5 to 95% by weight of at least one solvent. For the pretreatment and passivation of aluminium-rich surfaces, treatment liquids which have a content of the non-volatile film-forming mixture in the-region of 0.5 to 5% by weight, preferably 1 to 3% by weight, and 99.5 to 95% by weight of at least one solvent are suitable, in particular. For the coloured coating of substrates, treatment liquids which have a content of the non-volatile film-forming mixture in the region of 4 to 12% by weight, preferably 6 to 10% by weight, and 96 to 88% by weight of at least one solvent are suitable, in particular.

The concentrate preferably contains 5 to 80% by weight of a non-volatile film-forming mixture containing one or more resins, and 95 to 20% by weight of a water-miscible and/or water-soluble solvent and/or water, particularly preferably 10 to 70 or 90 to 30%6 by weight.

In this respect, the temperature of the treatment liquid is preferably kept at at least 35° C., particularly preferably at at least 40° C., very particularly at 50 to 70° C. However, the preferred temperature regions can vary according to the composition of the treatment liquid and the desired layer, and can also be displaced, for example, to temperatures in the region of 75 to 95° C.

A prerequisite for a successful continuous use of the treatment liquid in accordance with the invention is its stability over at least one month, preferably over at least 6 months, particularly preferably over at least two years, with the treatment liquid during this period being appropriately replenished and adapted to the working conditions: the constituents of the treatment liquid during the operating period, during the standing period and at the temperature of the film formation should not or should almost not coagulate, should not or should not substantially settle and should not be or should not be substantially decomposed, and their molecular weight distribution and viscosity should not substantially change in use. In this respect, a certain coagulation, decomposition, settling and/or change of molecular weight and viscosity cannot be entirely excluded, because the equilibrium of the treatment liquid can be more greatly strained by the dipping-in of hot parts and the entry of foreign matter (contamination).

Advantageously, the treatment liquid has a viscosity like that of water or only a slightly increased viscosity, because it then also reaches regions of the parts to be treated which are difficult to reach, for example bores, threads and cavities.

The treatment liquid is preferably produced by diluting a concentrate with water and/or a solvent mixture containing water. In this respect, a defoaming agent, a levelling agent and/or a wetting agent can optionally be added. It is to be observed that, in the adjustment of the treatment liquid it is adequately neutralized. The portion of an organic solvent can be dispensed with in particular if the volatility of the neutralization agents is coordinated in such a way that an adequate bath stability with increased working temperatures is guaranteed.

The cross-linked polymer dry film in accordance with the invention is usually more water-resistant, more mechanically resistant, more resistant to weathering and more flexible than a film-formed dry film, as has been produced, for example, by way of physical drying. The cross-linked dry film in accordance with the invention sometimes also produces a greater sheen than films according to the prior art, which were formed by physical drying. The films in accordance with the invention are formed to be surprisingly even and sealed. The hardened polymer film in accordance with the invention displays an optimum barrier action against weathering influences, against chemicals, for example used in an automobile, such as fuels, oils, battery acids, brake liquids etc. This high film quality is normally not achieved with a filmed dry film according to the prior art, which is produced from a dispersion by physical drying.

Compared with the methods for applying a polymer film, known in the prior art, the method in accordance with the invention has the advantage that the polymer film can be applied from a treatment liquid with the dipping method, with the treatment liquid containing only a small concentration of the non-volatile components and therefore being comparatively economical. The dipping method in accordance with the invention has the advantage of managing without costly industrial engineering, and nevertheless leads to evenly distributed dry layer thicknesses on geometrically simple or complicated parts.

Surprisingly, it has been established that with the method in accordance with the invention it is possible to generate pretreatment layers which are equivalent to those in conventional chromating, for example on aluminium alloys, but which can be attained without the use of chromium compounds. The protective films in accordance with the invention are even superior to the coatings or conventional chromating to some extent.

Moreover, it has unexpectedly been shown that the addition of an N-ethyl morpholine complex is particularly advantageous. The method in accordance with the invention can be successfully used in the production of parts of aluminium or aluminium alloys, in particular of assembled motor vehicle bodies provided with a bonding agent layer, with the heat of the tempering or hardening being used for the initial temperature for the dipping method in accordance with the invention. In this respect, for example, temperatures at the beginning of the wetting with the treatment liquid in the region of 220 to 160° C. can be used. The method, in accordance with the invention, for applying the polymer film is excellently suited to protecting in a lasting manner the work pieces based on aluminium without additional coating—as with an additional cathodic dipping lacquer. An electrodeposition paint can therefore be saved.

Unexpectedly, it has been possible to develop a method which, both without the use of chromium compounds and in some cases without the use of organic solvents, leads to passivation layers which are approximately equivalent to, in individual properties partially even superior to, those of chromating and phosphating.

Furthermore, in the pretreatment of hot-galvanized work pieces, it has proven advantageous to use the method in accordance with the invention immediately after the hot galvanizing, with it being possible to achieve in place of the slow cooling of the hot-galvanized parts with the influence of air at ambient temperature, a clear shortening of the subsequent cooling period by the dipping into the treatment liquid in accordance with the invention.

The invention is fundamentally also suitable for so-called endless work pieces such as wires, profiles and metal strips—narrow-strip, medium-strip and wide-strip.

The substrates coated with a film in accordance with the invention can be used to produce sheets, car bodies, bumpers, chassis, profiles, crash barrier elements, shelf elements, fence elements, heating elements, moulded parts of complicated geometry or small parts. They can be used in particular for preassembled car bodies and their parts in the manufacture of vehicles, trailers, motor caravans or flight bodies, for covers, housings, lamps, lights, traffic light elements, frames of spectacles, screws, nuts, springs, flanges, pieces of furniture, for example garden furniture, or furniture components. The invention is generally also particularly advantageous with parts with cavities, for example parts manufactured from or with pipes and/or profiles which are accessible to a lacquering only to a limited extent, in particular window and door frames, car bodies, bicycle frames, tubular constructions for the protection of electrical leads or also household devices, for example jugs and toasters. The method in accordance with the invention can be used advantageously for parts which were formed possibly by reshaping for example cold, cold massive, hot forming, drawing, pressing, extrusion etc. or by casting.

EXAMPLES

The invention will be explained by way of example in the following.

Examples 1 and 2 in Accordance With the Invention: Hot-galvanized Plates

Plates of about 100×100 mm size and of a thickness of 2.3 and 5 mm of a commercial steel were hot-galvanized. The zinc content of the zinc layer amounted to more than 98%. Upon removal of the plates, the zinc melt had a temperature in the region of 445 to 455° C. After removal from the hot-galvanizing bath the plates were dipped into the treatment liquid after, a delay in time. The treatment liquid had a temperature of about 60° C. because the bath, in this respect, was kept substantially constant at this temperature. This led to a spontaneous cooling of the hot plates. The temperature of the plates, for example when dipping into the treatment liquid, was measured with a temperature sensor at the plate surface. In each case five plates were coated under the same conditions. The dwell time amounted to 5 to 10 seconds and was selected in such a way that the reactions in the liquid upon removal were almost finished. The non-volatile component in the treatment liquid in Examples 1 and 2 amounted in each case to 1.2 and 2.4% by weight.

The treatment liquid of Example 1 contained the air-drying, transparent Formulation 1 of 30% by weight of an acid-functional acrylate resin based on pure acrylate and methacrylate and 70% by weight of an acid-functional styrene acrylate resin. This treatment liquid was intended for the chromium-free conservation of piece goods zinc-coated surfaces. Additives for adjusting defoaming, surface wetting and levelling were used as additions. Ammonia, 2-dimethylaminoethanol and 2-amino-2-methyl-1-propanol in the ratio 1:1:1 were used for the neutralization of the acid groups of the resins, and completely deionised water was used as solvent. The resin mixture was therefore able to dissolve well in water in the temperature range of 15 to 100° C. over long operating periods and was particularly well suited for the treatment of about 400 to 430° C. hot parts which were hot-galvanized immediately beforehand. Despite the high temperatures of the parts dipped in, the treatment liquid was stable for a long time.

The treatment liquid of Example 2 contained, instead, 90% by weight of a Formulation 2 based on polyurethane, acrylate and polyester as well as 10% by weight of a melamine formaldehyde resin. The remaining conditions were selected as with Example 1. This treatment liquid was intended for the furnace-drying transparent chromium-free pretreatment, cross-linking at increased temperature, and/or treatment of piece goods zinc-coated surfaces and the surfaces of aluminium or aluminium alloys. The films generated with the formulation 2 then had to be treated at temperatures in the region of 140 to 200° C. for a period of 30 to 10 minutes for the final hardening of the film. This treatment liquid was particularly well suited to the treatment of zinc-coated surfaces in the automobile industry, because it was also lastingly stable at the high temperatures.

After the coating of the respective plates of Examples 1 and 2, the polymer films were optically checked. The layer weight of the polymer film could only be determined approximately. A layer weight of 1 g/m$^2$ corresponds approximately to a layer thickness of 1 $\mu$m. The layer deposit in the region of 0.5 to 5 $\mu$m was determined gravimetrically and averaged over 5 values. The layer deposit greater than 5 $\mu$m was determined with the aid of a permascope of the Fischer company and was averaged over 10 values.

TABLE 1

Tests for Example 1 on hot-galvanized steel plates

| Test | Initial dipping bath | Wall thickness of dipping object | Temperature of dipping bath | Substrate temperature before the dipping | Substrate temperature after the dipping | Dry layer thickness* |
|---|---|---|---|---|---|---|
| 1 | 98.8% by weight | 2 mm | 60° C. | 400° C. | 70° C. | 0.7 $\mu$m |
| 2 | water | | | 300° C. | 70° C. | 0.7 $\mu$m |
| 3 | 1.1% by weight | | | 200° C. | 70° C. | 0.7 $\mu$m |
| 4 | formulation 1 | | | 100° C. | 60° C. | 0.4 $\mu$m |
| 5 | 0.1% by weight | 3 mm | | 400° C. | 90° C. | 1.2 $\mu$m |
| 6 | additives | | | 300° C. | 85° C. | 1.0 $\mu$m |

TABLE 1-continued

Tests for Example 1 on hot-galvanized steel plates

| Test | Initial dipping bath | Wall thickness of dipping object | Temperature of dipping bath | Substrate temperature before the dipping | Substrate temperature after the dipping | Dry layer thickness* |
|---|---|---|---|---|---|---|
| 7 | | | | 200° C. | 80° C. | 0.8 μm |
| 8 | | | | 100° C. | 70° C. | 0.7 μm |
| 9 | | 5 mm | | 400° C. | 120° C. | 2.7 μm |
| 10 | | | | 300° C. | 110° C. | 1.8 μm |
| 11 | | | | 200° C. | 90° C. | 1.2 μm |
| 12 | | | | 100° C. | 70° C. | 0.7 μm |
| 13 | 97.6% by weight | 2 mm | 60° C. | 400° C. | 70° C. | 1.6 μm |
| 14 | water | | | 300° C. | 70° C. | 1.6 μm |
| 15 | 2.2% by weight | | | 200° C. | 70° C. | 1.6 μm |
| 16 | formulation 1 | | | 100° C. | 60° C. | 1.1 μm |
| 17 | 0.2% by weight | 3 mm | | 400° C. | 90° C. | 2.3 μm |
| 18 | additives | | | 300° C. | 85° C. | 2.1 μm |
| 19 | | | | 200° C. | 80° C. | 1.9 μm |
| 20 | | | | 100° C. | 70° C. | 1.7 μm |
| 21 | | 5 mm | | 400° C. | 120° C. | 5.2 μm |
| 22 | | | | 300° C. | 110° C. | 5.0 μm |
| 23 | | | | 200° C. | 90° C. | 4.4 μm |
| 24 | | | | 100° C. | 70° C. | 4.2 μm |

*after the evaporation of the volatile components, average of 5 samples

Table 1 indicates a great dependence of the film thickness as a function of the plate thickness and therefore of the heat content of the substrates. The films on the 5 mm thick plates were not only formed so as to be thicker as a result of the high heat content, but also provided a substantially better protection against corrosion than thinner films. All films on the zinc-coated steel plates were optically perfect: the transparent films were sealed. The layer thickness distribution fluctuated only slightly from plate to plate. No substantial thickening of the protective films was found at the run-off edges.

In the testing of plates of Examples 1 and 2 the result was that all films on the zinc-coated steel plates were optically perfect: the transparent films were sealed. The layer thickness distribution fluctuated only slightly from plate to plate. No substantial thickening of the protective films was found at the run-off edges. Only small differences were found between the films which were generated with the treatment liquids of Examples 1 and 2.

Comparative Examples of Hot-galvanized Steel Plates

For the Comparative Examples 1 to 6, hot-galvanized and then cooled steel plates were used. In comparative Example 6 the hot-galvanized plate was not coated further. The dwell time amounted to 5 to 10 seconds and was therefore approximately selected as with the examples in accordance with the invention, although no bubbling occurred as an indication of a reaction. In this respect, neither did the dwell time have any significant influence on the formation of the layer thicknesses. The coated plates were air-dried. The remaining working conditions were otherwise the same as in Example 1.

TABLE 2

Tests for Comparative Examples 1 to 5 on hot-galvanized steel plates: treatment liquid and parts at ambient temperature (about 20° C.)

| Comparative example | Initial dipping bath | Wall thickness of dipping object | Temperature of dipping bath | Substrate temperature before the dipping | Substrate temperature after the dipping | Dry layer thickness* |
|---|---|---|---|---|---|---|
| CE 1 | 98.8% by weight water<br>1.1% by weight formulation 1<br>0.1% by weight additives | 2 mm | 20° C. | 20° C. | 20° C. | 0.1 μm |
| CE 2 | 92.5% by weight water<br>6.9% by weight formulation 1<br>0.6% by weight additives | 2 mm | 20° C. | 20° C. | 20° C. | 1.0 μm |
| CE 3 | 87.5% by weight water<br>11.5% by weight | 2 mm | 20° C. | 20° C. | 20° C. | 1.5 μm |

TABLE 2-continued

| Comparative example | Initial dipping bath | Wall thickness of dipping object | Temperature of dipping bath | Substrate temperature before the dipping | Substrate temperature after the dipping | Dry layer thickness* |
|---|---|---|---|---|---|---|
| | Tests for Comparative Examples 1 to 5 on hot-galvanized steel plates: treatment liquid and parts at ambient temperature (about 20° C.) | | | | | |
| | formulation 1 1.0% by weight additives | | | | | |
| CE 4 | 94.0% by weight water 6.0 parts by weight formulation 4 | 2 mm | 20° C. | 20° C. | 20° C. | 1.0 μm |
| CE 5 | 90.0% by weight water 10.0 parts by weight formulation 4 | 2 nm | 20° C. | 20° C. | 20° C. | 2.1 μm |

*after the evaporation of the volatile components, average of 5 samples

TABLE 3

Qualitative evaluation of the layer quality with respect to white rust formation on hot-galvanized steel plates in Example 1 in comparison with the Comparative Examples 1, 2 and 6

| Example or comparative Example | Open weathering after 4 weeks % white rust on the surface | Open weathering after 6 months % white rust on the surface | Open weathering after 12 months % white rust on the surface | DIN 50 017 KK after 360 h % white rust on the surface |
|---|---|---|---|---|
| Inv. Ex 1 | 0 | 2 | 10 | 10 |
| Inv. Ex 4 | 1 | 20 | 40 | 60 |
| Inv. Ex 5 | 0 | 0 | 2 | 0 |
| Inv. Ex 8 | 1 | 10 | 15 | 5 |
| Inv. Ex 17 | 0 | 0 | 0 | 0 |
| CE 1 | 100 | 100 | 100 | 100 |
| CE 2 | 5 | 20 | 40 | 60 |
| CE 6: substrate untreated | 100 | 100 | 100 | 100 |

In comparison with Examples 1 and 2, Comparative Examples 1 to 5 showed that the dipping treatment of surfaces with a temperature of about 20° C. in a treatment liquid of about 20° C. generates a dry layer which is thinner approximately by a factor of 7 with the same concentration of the non-volatile film-forming components in the treatment liquid than if the treatment liquid is heated to 60° C. and the substrates to be treated have beforehand a temperature in the region of 200 to 400° C. This means that the concentration of the non-volatile film-forming component in the treatment liquid would have to be increased by about a factor of 7 in order to achieve similar layer thicknesses at ambient temperature, which would have a very negative effect on the investment costs. Particularly disadvantageous is the fact that at ambient temperatures an overcoating occurs at the run-off edges and in the region of bores and threads and the parts are useless as a result of a lack of dimensional accuracy.

Open weathering tests in an industrial atmosphere and condensed moisture constant climate tests according to DIN 50 017 KK were carried out on selected samples. In this respect, as a result of the layer thickness distributions greatly fluctuating on a respective individual plate, there resulted in Comparative Examples 1 and 2 a protection against corrosion inadequate at places coated more thinly. In this respect, Comparative Example 1 showed such poor results that the protection against corrosion was not better than without the supposedly anti-corrosion coating, as Comparative Example 6 proves.

The run-off edges showed substantially thicker coatings than the other surfaces. Layer thicknesses of more than 50 μm appeared in part at the run-off edges.

Example 3 in Accordance With the Invention: Formulation 2 for Aluminium Alloys Parallel tests with the treatment liquid of Example 2 on an aluminium alloy usual in the automobile industry led to equally good results as on zinc-coated plates.

For this purpose, the plates consisting of an aluminium alloy frequently used in the automobile industry were passivated beforehand on a Tl/Zr base. Immediately subsequent to the heat treatment with tempering, optionally with temporal delay for the slow cooling or for the completeness of the line of tests, the plates were heated yet a little more, and dipped approximately at the indicated desired temperature (Table 4). In this respect, a concentration of the non-volatile constituents of the treatment liquid of 2.4% by weight was used. The treatment liquid is excellently suited in particular for a coating of parts which have a temperature in the region of 160 to 250° C. The other working conditions were the same as in Example 2. The results prove that with the same concentrations of chemically very different formulations and with the same dipping bath parameters, the same layer thicknesses can be generated. The coatings were optically perfect: the layers were sealed, the layer thickness distribution was even and no substantial thickenings occurred at the run-off edges.

subsequently treated at temperatures in the region of 140 to 200° C. for a period of 30 to 10 minutes for the final hardening. The quality of the polymer film was tested without applied car surface lacquer. The coatings were optically perfect: the layers were sealed, the layer thickness distribution was even and no substantial thickenings occurred at the run-off edges. After the application of the surface lacquer, all tests for determining the adhesion by way of square-cut adhesion method produced perfect results. The entire layer sequence fulfilled the physical-technical tests of an automobile lacquering.

TABLE 4 tests for Example 3 (tests 25–28), Example 4 (tests 29–32) and Example 5 (tests 33–40) on aluminium alloys

| Test | Initial dipping bath | Wall thickness of dipping object | Temperature of dipping bath | Substrate temperature before the dipping | Substrate temperature after the dipping | Dry layer thickness* |
|---|---|---|---|---|---|---|
| 25 | 97.6% by weight | 3 mm | 60° C. | 400° C. | 90° C. | 2.3 μm |
| 26 | water | | | 300° C. | 85° C. | 2.1 μm |
| 27 | 2.2% by weight | | | 200° C. | 80° C. | 1.9 μm |
| 28 | formulation 2 0.2% by weight additive | | | 100° C. | 70° C. | 1.7 μm |
| 29 | 97.6% by weight | 3 mm | 60° C. | 400° C. | 90° C. | 2.3 μm |
| 30 | water | | | 300° C. | 85° C. | 2.1 μm |
| 31 | 2.2% by weight | | | 200° C. | 80° C. | 1.9 μm |
| 32 | formulation 3 0.2% by weight additives | | | 100° C. | 70° C. | 1.7 μm |
| 33 | 94.0% by weight | 2 mm | 60° C. | 400° C. | 70° C. | 10 μm |
| 34 | water | | | 300° C. | 70° C. | 10 μm |
| 35 | 6.0 parts by weight | | | 200° C. | 70° C. | 19 μm |
| 36 | formulation 4 | | | 100° C. | 60° C. | 8 μm |
| 37 | 90.0% by weight | 2 mm | 60° C. | 400° C. | 70° C. | 22 μm |
| 38 | water | | | 300° C. | 70° C. | 20 μm |
| 39 | 6.0 parts by weight | | | 200° C. | 70° C. | 20 μm |
| 40 | formulation 4 | | | 100° C. | 60° C. | 17 μm |

* after the evaporation of the volatile components, average of 5 samples

Example 4 in Accordance With the Invention: Film Formation on an Aluminium Alloy and Subsequently Applied Car Surface Lacquer For this example, substrates consisting of an aluminium alloy usual in vehicle construction were used. The substrates were Cr-free passivated beforehand with a coating consisting of at least one Zr/Ti compound. Immediately subsequent to the heat treatment with tempering, optionally with temporal delay for the slow cooling and for the completeness of the line of tests, the plates were heated yet a little more and approximately dipped at the indicated desired temperature (Table 4). The treatment liquid of Example 4 contained 95% by weight of a Formulation 3 based on polyurethane and acrylate as well as 5% by weight of a melamine formaldehyde resin. In this respect, a concentration of the non-volatile constituents of the treatment liquid of 2.4% by weight was used. The other conditions were maintained as in Example 2. This treatment liquid was intended for transparent, chromium-free treatment drying in the furnace at increased temperature and/or pretreatment of the surfaces of aluminium or aluminium alloys. This treatment liquid was just as well suited as the treatment liquid of Examples 2 and 3. The films generated with the Formulation 3 still had to be

Example 5 in Accordance With the Invention: Film Formation on an Aluminium Alloy as Single Layer Lacquer Treatment The plates consisting of an aluminium alloy frequently used in the automobile industry were cleaned in a water-wetting manner in order to remove oil residues and dirt. They were not passivated. The parts were heated to a temperature just above the temperature at which the parts were dipped into the treatment liquid (Table 4). The dwell time amounted to 5 to 10 seconds and was selected such that the reactions in the liquid upon removal were almost ended. The treatment liquid of Example 5 contained 54.7% by weight of a Formulation 4 based on acrylate, methacrylate, styrene and polyester and 30% by weight of a rutile white pigment, 0.3% by weight of a colour black pigment, 9.0% by weight of silicate and 6.0% by weight of other additives for defoaming, levelling, wetting, the neutralization and adjustment of the rheology. In this respect, a concentration of the non-volatile constituents of the treatment liquid of 6 or 10% by weight was used in order to generate thicker coloured protective films. The coated plates were then air-dried. This treatment liquid was intended for the air-drying, grey, chromium-free conservation of diverse small parts of steel, zinc-coated steel, aluminium, cast aluminium, cast zinc and cast iron. The treatment liquid was excellently suitable for cast aluminium parts because it was lastingly stable. The coatings were optically perfect: the layers were sealed, the layer thickness distribution was even and no substantial thickenings occurred at the run-off edges. The quality of the coating corresponded to the level of quality of a single layer spray lacquering applied by the usual methods.

Comparison of Example 3 with Comparative Examples 7 to 9: Aluminium Alloys

For the comparative Examples 7 to 9 conventional coating methods were used on sheets of aluminium alloys.

TABLE 5

Evaluation of the layer quality without subsequent lacquering with regard to the quality of the protection against corrosion on aluminium alloys

| Example or comparative example | Salt-spray test according to DIN 50 021 SS: % corroded surface | Alternative test according to VDA 621-415: % corroded surface | Open weathering according to VDA 621-414: % corroded surface |
|---|---|---|---|
| Example 3, test 27 | after 720 h<br>0% corrosion<br>—<br>— | after 5 rounds<br>0% corrosion<br>after 10 rounds<br><5% corrosion | after 6 months<br>0% corrosion<br>—<br>— |
| CE 7: yellow chromating | after 720 h<br>0% corrosion | after 5 rounds<br>0% corrosion | after 6 months<br>20% corrosion |
| CE 8: green chromating | after 720 h<br>0% corrosion | after 5 rounds<br><5% corrosion | after 6 months<br>30% corrosion |
| CE 9: zinc phosphate | after 24 h<br>0% corrosion<br>after 168 h<br>20% corrosion | after 5 rounds<br>40% corrosion<br>—<br>— | after 1 month<br>60% corrosion<br>after 6 months<br>100% corrosion |

Salt-spray tests according to DIN 50 021 SS, alternative tests according to VDA 621-415 and open weathering tests according to VDA 621-414 were carried out on selected samples. In this respect, the result was that Example 3, Test 27, in the salt-spray test and in the alternate test [produced] equivalent results in comparison with the conversion layers of the highest grade conventional methods (CE 7 and 8), but superior resistance to corrosion compared with a zinc phosphate layer. On the other hand, the coating in accordance with the invention is far better than the highest grade conventional coatings with respect to the open weathering. In this respect, it is to be considered that only Example 3, Test 27 was passivated beforehand with Ti/Zr fluorine, but not the substrates of the Comparative Examples 7 to 9, because the latter cannot be coated in accordance with the invention with such a passivation. The layer thickness in the region of the run-off edges in Example 3, Test 27 was only minimally greater than on the larger surfaces.

What is claimed is:

1. Method for producing a plastic film or a plastics-containing film on a metal surface of a substrate by wetting said surface with a treatment liquid, in which said treatment liquid, which immediately prior to wetting said surface contains 0.1 to 50% by weight of a non-volatile film-forming mixture containing one or more resins, said resins containing neutralized groups, whereby neutralization occurs due to the presence of one or more neutralizing agents contained in said treatment liquid having pH values in the 7–9.5 range, and 99.9 to 50% by weight of a water miscible and/or water-soluble solvent and/or water, forms a film on said metal surface, with any present volatile component in said liquid evaporating at least in part, wherein immediately prior to wetting said substrate said treatment liquid has a temperature in the range of 10 to 100° C., and said metal surface has a temperature higher than the treatment liquid by at least 20° C. and a temperature in the region of 30 to 700° C., and in that the film is used for treating the metal surface.

2. Method according to claim 1, wherein, before the wetting with the film-forming treatment liquid, the metal surface is provided with a bonding agent layer.

3. Method according to claim 1, wherein said resin or the resins are synthetic resins.

4. Method according to claim 1, wherein said resin or resins are present as a solution or a dispersion.

5. Method according to claim 1, wherein in addition to said resin or resins, the non-volatile, film-forming mixture contains at least one inorganic additive in dissolved form and/or as finely dispersed powder.

6. Method according to claim 1, wherein at least one water-miscible and/or water-soluble alcohol, a glycol ether or N-methyl pyrrolidone and/or water is used as solvent for said resins.

7. Method according to claim 1, wherein the treatment liquid contains at least one volatile and/or non-volatile additive for the adjustment of defoaming, adhesion, conservation, neutralization, surface wetting, rheology and/or leveling.

8. Method according to claim 1, wherein the pH value of the treatment liquid is kept in the range of 1 to 11.

9. Method according to claim 1, wherein the film is also formed by physical film forming.

10. Method according to claim 1, wherein the film is applied to the metal surface by dipping the substrate into the treatment and by subsequently drying, with the substrate at the beginning of the wetting with the treatment liquid having a temperature in the region of 100 to 200° C.

11. Method according to claim 1, wherein the film is applied to the metal surface by flooding the substrate with the treatment liquid and by subsequent drying, with the substrate at the beginning of the wetting with the treatment liquid having a temperature in the region of 12 to 150° C.

12. Method according to claim 1, wherein the film is applied to the metal surface by spraying the substrate with the treatment liquid and by subsequent drying, with the substrate at the beginning of the wetting with the treatment liquid having a temperature in the region of 12 to 70° C.

13. Method according to claim 1, wherein the film is applied to the metal surface by wetting the substrate with the treatment liquid by wiping it on, brushing it on or rolling it on and by subsequent drying, with the substrate at the beginning of the wetting with the treatment liquid having a temperature in the range of 12 to 70° C.

14. Method according to claim 1, wherein the substrate is brought to the required temperature by annealing, hot dip coating or tempering.

15. Method according to claim 1, wherein the substrate is rapidly quenched, with the temperature of the substrate lying at least 80° C., above the temperature of the treatment liquid.

16. Method according to claim 1, wherein a layer thickness of the film after the drying of 0.01 to 50 $\mu$m is formed.

17. Method according to claim 16, wherein said film is subsequently thermally treated for a final chemical cross-linking and physical hardening.

18. Method according to claim 1, wherein said film is hardened by UV radiation.

19. Method according to claim 1, wherein the substrate is lacquered, wherein a subsequent thermal treatment for a final chemical cross-linking and physical hardening of the film is carried out, and wherein said thermal treatment simultaneously hardens said lacquer layer.

20. Method according to claim 1, wherein aluminum alloy components are coated with said film at the temperature at which said components are heated.

21. Method according to claim 1, wherein corrosion inhibitors are added as pigments and/or in dissolved form.

22. The method according to claim 1, wherein a lacquer layer, a foil, a foam and/or an adhesive are additionally applied to the substrate, with the substrate optionally being bonded with a further moulded body or with a foil.

23. Method according to claim 1, wherein the substrate to be coated is a sheet, a car body or a part of a car body, a part of a vehicle, trailer, motor craven or flight body, a cover, a housing, a lamp, a light, a traffic-light element, a piece of furniture or furniture component, a component of a household device, a chassis, a profile, a moulded part of complicated geometry, a crash barrier element, heating element or fence element, a bumper, a part consisting of or with at least one pipe and/or a profile, a window frame, door frame, bicycle frame or a small part.

24. Method according to claim 1, wherein the substrate is produced by casting and/or rolling.

25. The method of claim 2, wherein said bonding agent layer comprises one or more of phosphate, silicate, zirconium, titanium, phosphonate, and silane.

26. The method of claim 2, wherein said resins comprise one or more of acrylates, polyesters, polyurethanes, silicon polyesters, epoxides, phenols, styrenes, resins based on urea formaldehyde, their mixtures and their copolymers.

27. The method of claim 5, wherein said additive comprises one or more of carbonate chromate, oxide, silicates, and sulphate.

28. The method of claim 6, wherein said solvent comprises one or more of propylene glycol, an ester alcohol, a glycol ether, butandiol with water, or water.

29. The method of claim 1, wherein at least one of said neutralizing agents comprises one or more of an amine, ammonia and/or sodium hydroxide solution.

30. The method of claim 29, comprising of at least two neutralizing agents selected from the group consisting of long volatile neutralization agents, medium-sized volatile neutralization agents, and short volatile neutralization agents.

* * * * *